US009818298B2

(12) United States Patent
Loffl et al.

(10) Patent No.: US 9,818,298 B2
(45) Date of Patent: Nov. 14, 2017

(54) METHOD, EVALUATING COMPUTER, AND ON-BOARD COMPUTER FOR INFLUENCING A TRAFFIC LIGHT SIGNAL SYSTEM

(75) Inventors: Karlheinz Loffl, Karlsruhe (DE); Andreas Mörder, Waghäusel (DE); Matthias Kühn, Karlsruhe (DE)

(73) Assignee: INIT Innovative Informatikanwendungen in Transport, Karlsruhe (DE)

( * ) Notice: Subject to any disclaimer, the term of this patent is extended or adjusted under 35 U.S.C. 154(b) by 679 days.

(21) Appl. No.: 13/393,352

(22) PCT Filed: Dec. 14, 2010

(86) PCT No.: PCT/DE2010/001469

§ 371 (c)(1),
(2), (4) Date: Feb. 29, 2012

(87) PCT Pub. No.: WO2011/079834

PCT Pub. Date: Jul. 7, 2011

(65) Prior Publication Data

US 2012/0229303 A1 Sep. 13, 2012

(30) Foreign Application Priority Data

Jan. 4, 2010 (DE) ..... 10 2010 004 020
Feb. 22, 2010 (DE) ..... 10 2010 008 852

(51) Int. Cl.
*G08G 1/07* (2006.01)
*G08G 1/087* (2006.01)

(52) U.S. Cl.
CPC ..... *G08G 1/087* (2013.01)

(58) Field of Classification Search
CPC ..... G08G 1/087
(Continued)

(56) References Cited

U.S. PATENT DOCUMENTS 4,573,049 A * 2/1986 Obeck ..... G08G 1/087 340/12.5
6,243,026 B1 * 6/2001 Jones ..... G08G 1/07 340/906

(Continued)

FOREIGN PATENT DOCUMENTS

DE 199 63 942 A1 8/2000
DE 103 41 189 A1 8/2004

(Continued)

OTHER PUBLICATIONS

International Search Report and Written Opinion from International Application No. PCT/DE2010/001469, filed Dec. 14, 2010.

(Continued)

*Primary Examiner* — Zhen Y Wu
(74) *Attorney, Agent, or Firm* — Alston & Bird LLP

(57) ABSTRACT

The invention relates to a method for influencing a traffic light system provided with an evaluating computer by a vehicle, in particular in public transportation, the vehicle sending a data telegram to the evaluating computer at a sending position in order to request a green phase and the data telegram and/or the sending position depending on predefined reporting points, characterized in that the data telegram is transmitted to the evaluating computer by means of a packet-oriented, in particular IP-based (Internet-Protocol-based) radio network and in that the sending position is moved forward according to the current speed of the vehicle and a maximum assumed data telegram propagation time as the vehicle approaches a reporting point.

20 Claims, 1 Drawing Sheet

(58) Field of Classification Search
USPC ..... 340/906, 907
See application file for complete search history.

(56) References Cited

U.S. PATENT DOCUMENTS

| | | | | |
|---|---|---|---|---|
| 6,621,420 | B1 * | 9/2003 | Poursartip | G08G 1/087 340/906 |
| 7,519,036 | B2 | 4/2009 | Zhang | |
| 8,780,857 | B2 | 7/2014 | Balasubramanian et al. | |
| 2003/0109972 | A1 * | 6/2003 | Tak | G06Q 10/02 701/31.4 |
| 2004/0189493 | A1 * | 9/2004 | Estus | G08G 1/20 340/988 |
| 2006/0059270 | A1 * | 3/2006 | Pleasant | H04L 41/06 709/237 |
| 2006/0261977 | A1 * | 11/2006 | Bachelder | G08G 1/20 340/906 |
| 2006/0273923 | A1 * | 12/2006 | Schwartz | G08G 1/0965 340/906 |
| 2007/0270120 | A1 * | 11/2007 | Zhang | G08G 1/087 455/344 |
| 2008/0084837 | A1 * | 4/2008 | Watanabe | H04W 72/005 370/312 |
| 2008/0316055 | A1 * | 12/2008 | Bachelder | F41G 9/00 340/906 |
| 2009/0180451 | A1 * | 7/2009 | Alpert | H04W 72/1215 370/338 |
| 2009/0189782 | A1 * | 7/2009 | Bachelder | G08G 1/087 340/906 |
| 2010/0295726 | A1 * | 11/2010 | Tann | G01C 21/30 342/357.24 |
| 2011/0109478 | A1 * | 5/2011 | Williamson | G08G 1/087 340/906 |
| 2011/0193722 | A1 * | 8/2011 | Johnson | G08G 1/081 340/906 |
| 2011/0218896 | A1 * | 9/2011 | Tonnon | G06Q 40/123 705/31 |

FOREIGN PATENT DOCUMENTS

| | | | |
|---|---|---|---|
| DE | 10 2008 024 656 | A1 | 11/2009 |
| GB | 2 418 113 | A | 3/2006 |

OTHER PUBLICATIONS

Mahmod, M. et al.; "Wireless Strategies for Future and Emerging ITS Applications"; Proceedings of the 15$^{th}$ World Congress on Intelligent Transport Systems; Nov. 20, 2008, XP002633152.

* cited by examiner

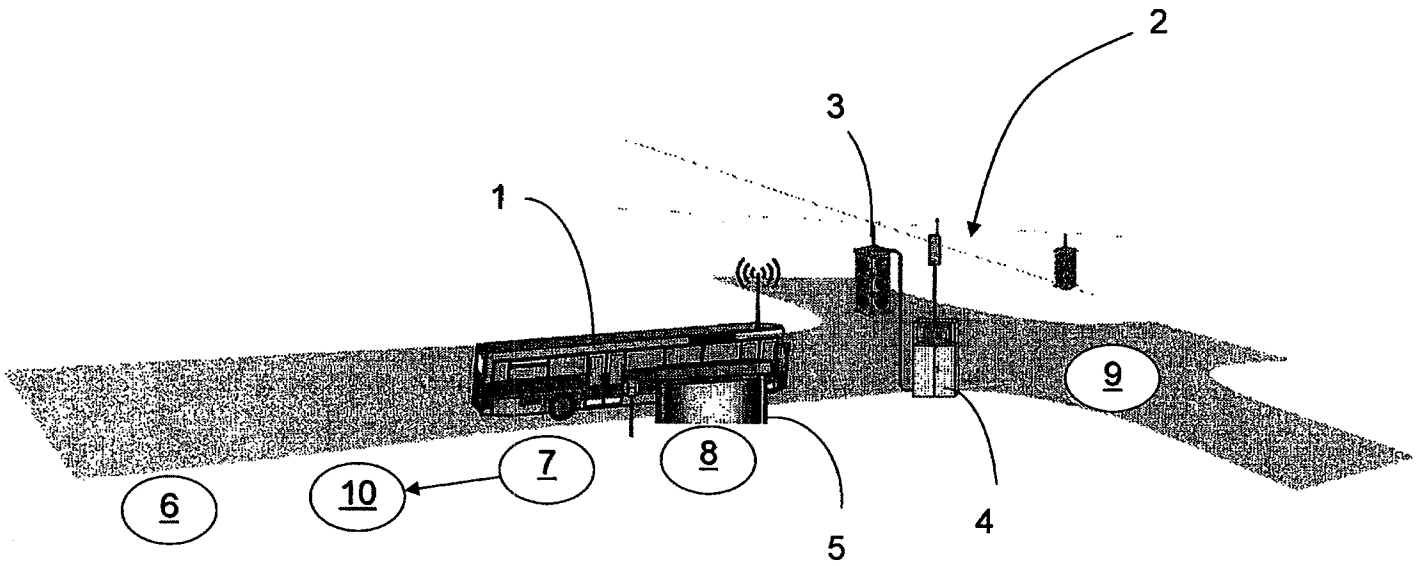
1
2
3
4
5
6
7
8
9
10

METHOD, EVALUATING COMPUTER, AND ON-BOARD COMPUTER FOR INFLUENCING A TRAFFIC LIGHT SIGNAL SYSTEM

BACKGROUND OF THE INVENTION

Field of the Invention

The invention relates to a method for enabling a vehicle to influence a traffic light signal system equipped with an evaluation computer, in particular in public transportation, wherein the vehicle at a sending position sends a data telegram to the evaluation computer to request a green phase, and wherein the data telegram and/or the transmission position depend on predefined reporting points.

In addition, the invention relates to an evaluation computer for influencing a traffic light signal system for performing the method according to the invention.

Finally, the invention relates to an on-board computer for a vehicle for influencing a traffic light signal system for performing the method according to the invention.

Description of Related Art

Methods and systems for influencing traffic light signal systems of the type defined in the introduction are known from practice in a wide variety of embodiments. The known systems make it possible to influence traffic light signal systems to optimize the driving times of vehicles. The traffic light signal system is influenced via data radio. To do so, a suitably equipped vehicle sends data telegrams to the traffic light signal systems via data radio on reaching reporting points. A certain data telegram is assigned to each reporting point here. The position of the vehicle is determined physically in the access area to the traffic light signal system by location synchronization. Depending on the local conditions, data telegrams are sent from the vehicle to the traffic light signal system, different data telegrams are sent from the vehicle to the traffic light signal system for influencing the traffic light signal system:

Advance log-on telegram: The vehicle is near the intersection, where the traffic light signal system is located. It will soon need a green phase.

Main log-on telegram: The vehicle is right at the intersection and needs a green phase now.

Station telegram: This data telegram is used when a station is located just in front of the traffic light signal system. The data telegram informs the traffic light signal system that the vehicle is ready to depart as soon as the doors of the vehicle are closed.

Log-out telegram: The vehicle has passed the intersection. The green time can now be terminated.

The data telegrams that are sent are received, decoded and processed by an evaluation unit assigned to the traffic light signal system. Next the processed data is made available to the control unit for control of the traffic light signal system. The intervention into the control unit results from this. The control unit processes all the information contained in the data telegram, such as the reporting point number, schedule deviation and a priority code.

One of the most important requirements and boundary conditions in influencing traffic light signal systems is that the transmission time of the data telegrams and/or the position (reporting points) at which the data telegrams are sent must be upheld very precisely. The log-out point, i.e., the position and/or time after which the intersection may be released again for normal traffic is especially critical. The vehicle should not send the log-out message too soon, so as not to cause it to switch to red at the last moment, but should also not send it too late if it has already left the intersection area. The vehicle should send the log-out message exactly at the planned departure point and should then release the intersection again.

The known influencing systems for traffic light signal systems use the analog radio telephone system with 4 m, 2 m or 70 cm frequency band. Depending on the requirements in the given application case, different types of data telegrams are used, also having different lengths:

| Type of telegram | Number of bytes | Number of bits | Telegram duration [ms] | Duration with up and switch times [ms] |
|---|---|---|---|---|
| R09.10 | 3 | 60 | 25 | 50 |
| R09.11 | 4 | 69 | 29 | |
| R09.12 | 5 | 78 | 33 | |
| . . . | . . . | . . . | . . . | |
| R09.16 | 9 | 114 | 48 | 80 |

From the above table, it can be seen that the simple transmission time in the radio network requires less than 100 ms. These systems are characterized in that a direct real time connection between the requesting vehicle and the stationary receiver side—traffic light signal system at the intersection—can be established (direct mode operation, DMO). The data telegrams are sent spontaneously by the vehicle on reaching a certain position. The known methods have the disadvantage that it is a unidirectional communication, i.e., only the vehicle sends a message and there is no acknowledgement on the part of the traffic light signal system. Furthermore, there is a collision of radio data telegrams when several vehicles send a request at the same time. Consequently, the transmission is not confirmed. To reduce these disadvantages, data telegrams today are repeated once or twice in an interval of time controlled by a random generator. Typical values here are in the range of 200 to 800 ms. Starting from a vehicle speed of 36 km/h (1 m per 100 ms), the lack of precision caused by the radio system is in the range of 1 m to max. 10 m.

In addition, today there are more and more systems in short-range public transportation which rely on an IP-based digital wireless infrastructure, such as GPRS or UMTS, for example, for data communication between vehicle and control station. Nevertheless, approaches based on the analog radio telephone system are still being used to influence traffic light signal systems today but these would then require special equipment—data telegram transmitters—in the vehicle. It is thus a special disadvantage of systems which use the radio telephone that separate vehicle equipment is needed to use this system and separate frequencies are needed for the radio telephone.

The object of the present invention is therefore to provide and improve upon a method, an evaluation computer and an on-board computer for enabling a vehicle to influence a traffic light signal system, such that a prompt influence on the traffic light signal system is ensured by using simple design means.

SUMMARY OF VARIOUS EMBODIMENTS

The object defined above is achieved by the various method embodiments described herein. According to this, the generic method for enabling a vehicle to influence a traffic light signal system equipped with an evaluation computer is characterized in that the data telegram is transmitted to the evaluation computer over a packet-oriented, in particular IP (Internet protocol) based radio network, and that in the approach of the vehicle to a reporting point the transmission position is moved forward as a function of the current speed of the vehicle and a maximum assumed data telegram transit time.

At this point, it should be noted that the method according to the invention may be used for all radio systems in which the telegram transmit time varies. It does not matter whether they are IP-based systems or a different type of data link, such as SDS (short data service) in TETRA (terrestrial trunked radio) or SMS (short message service) in GSM (global system for mobile communications).

In the inventive manner, it was first recognized once that it is an enormous advantage to also use the technology present in a vehicle anyway for data communication over a packet-oriented, in particular IP (Internet protocol) based radio network with the control station for communication with the traffic light signal system. The transmission is then not possible in the direct mode (DMO) in contrast with influencing a traffic light signal system via radio telephone. Because of the use of packet services, consequently there is no direct real time link between the transmitting vehicle and the receiving traffic light signal system unit. Thus because of the latency time of the system, no reliable prediction can be made of when a data telegram, in particular a UDP (user datagram protocol) data telegram will arrive at the receiver. The latency time may vary and must be taken into account. In a further method according to the invention, it has been recognized that this can be compensated by moving the transmission position forward as a function of the current speed of the vehicle and a maximum assumed data telegram transit time, as the vehicle approaches a reporting point.

Consequently, the method according to the invention describes a method according to which a prompt influence on the traffic light signal system is ensured using simple design means.

With regard to the power supply to the reporting points in a scheduling system, these reporting points are supplied with modified attributes and additional parameters. A reporting point may expediently be defined by a destination address of the evaluation computer, e.g., the destination IP address and the respective destination port and the actual reporting point number.

In an advantageous manner, the maximum assumed data telegram transmit time can be defined globally, e.g., by parameters. Thus the transmission point in time of the data telegram can be dynamically advanced as a function of the current speed of the vehicle and the globally defined maximum data telegram transmit time—latency time.

In an especially advantageous manner, the reporting point, transmission time and the maximum assumed data telegram transmit time can be transmitted to the evaluation computer with the data telegram.

With regard to securing the transmission of the data telegram, this data telegram can be sent repeatedly by the vehicle.

With regard to secure transmission of the data telegram, it is also conceivable that an acknowledgement mechanism will be used to transmit the data telegram, which would then signal to the vehicle successful transmission of the data telegram.

With regard to a correct influence on the traffic light signal system in time, the evaluation computer can calculate the transit time of the data telegram based on the difference between the reception time and the transmission time. In the case of a calculated transit time less than the maximum assumed data telegram transit time, further processing and/or forwarding of the data telegram may be delayed by a time difference. This time difference is obtained from the difference between the maximum assumed data telegram transit time and the calculated actual transit time of the data telegram.

If the calculated transit time of the data telegram is greater than the maximum assumed data telegram transit time, the data telegram may be discarded.

In a concrete embodiment, data telegrams to be triggered without delay may be provided with a certain identifier. Such data telegrams include, for example, manually triggered data telegrams or data telegrams, which are coupled to a door-closing criterion at a station. Since the transit time here cannot be compensated, a corresponding identifier, e.g., an unidentified value for the parameter of the maximum assumed data telegram transit time, may also be transmitted to the evaluation computer of the traffic light signal system for signal purposes.

With regard to prompt reception and appropriate processing of the data program, the transmission position of the vehicle may be moved forward, so that a higher speed of the vehicle and a data telegram having the maximum assumed data telegram transit time are taken into account.

With regard to a consistent and correct calculation of the transit time of a data telegram, the local time in the vehicle and in the evaluation computer may be synchronized. It is conceivable here for the clocks to base their time on the NTP (network time protocol) or SNTP (simple network time protocol) and/or a server available in the network. As a rule, the vehicle will have a GPS receiver by means of which the time can also be acquired.

In a particularly advantageous manner, the data telegram may be forwarded to the evaluation computer via a central application-router. In order for the vehicle to contact the installation at the intersection directly, the destination IP address of the evaluation computer must be visible for the vehicle. If this cannot be achieved by the network operator, for example, when using VPN (virtual private network), at various private APNs (access point names), at various network operators for vehicle and infrastructure or because of a lack of fixed destination IP addresses, then the data telegrams can be directed over such a central application that forwards the distribution of the data telegrams to the respective subscribers.

Essentially none of the subscribers should be visible from the public Internet but instead should be protected from interference from the outside via private accesses (private APNs). In the ideal case, the SIM (subscriber identity module) cards of the vehicles and the evaluation computers are registered by the same network operator and in the same VPN (private APN) and the SIM cards of the evaluation computers have fixed IP addresses. In addition, fundamentally different computers may be contacted, depending on the traffic light signal system if the reporting point data is supplied with an IP address and a port. In this case, the IP address may represent the IP address of the central router and then the port number corresponds to the destination address of the evaluation computer.

The method described here is fundamentally also suitable for all radio systems available currently and in the future that do not have a deterministic runtime performance with respect to the telegram transit times. The system is thus also suitable in particular for systems such as TETRA (SDS messaging) or GSM (SMS messaging).

With respect to a suitable evaluation computer for influencing a traffic light signal system, the object defined in the introduction is achieved by the various evaluation computer embodiments described herein. The evaluation computer has a transmission and/or reception unit in particular for GPRS (general packet radio service), EDGE (enhanced data rates for GSM evolution), UMTS (universal mobile telecommunications system), TETRA (terrestrial trunked radio), WLAN (wireless local area network) and/or WIMAX (worldwide interoperability for microwave access) for receiving the data telegram, and serves to implement the method according to the invention.

Specifically, it is conceivable that the evaluation computer may be operated by means of a serial interface or a relay interface in parallel with an analog evaluation unit. This ensures the possibility of a smooth migration because many intersections are already equipped with analog receivers and evaluation units and thus the vehicles of the traffic operations are also equipped with analog technology.

With respect to an on-board computer for enabling a vehicle to influence a traffic light signal system, the object defined in the introduction is achieved by the various on-board computer embodiments described herein. The on-board computer has a send and/or receive unit, in particular for GPRS (general packet radio service), EDGE (enhanced data rates for GSM evolution), UMTS (universal mobile telecommunications system), TETRA (terrestrial trunked radio), WLAN (wireless local area network) and/or WIMAX (worldwide interoperability for microwave access), for sending the data telegram, and serves to perform the method according to the invention.

The on-board computer advantageously has a module for automatic position determination, e.g., a GPS module or a Galileo module. In addition, navigation guides as well as optical or odometer-based positioning systems are also conceivable for automatic position determination.

BRIEF DESCRIPTION OF THE SEVERAL VIEWS OF THE DRAWINGS

Now there are various possibilities for embodying and refining the teaching of the present invention in an advantageous manner. Reference is therefore made to the patent claims which depend on patent claim 1, on the one hand, and to the following explanation of a preferred exemplary embodiment of the invention with reference to the drawings on the other hand. In combination with the explanation of the preferred exemplary embodiment of the invention with reference to the drawings, preferred embodiments and refinements of the teaching are also explained in general. The drawing is shown in the only FIGURE:

FIG. 1 showing the basic sequence of the method according to the invention in a schematic view.

DETAILED DESCRIPTION

FIG. 1 shows the fundamental sequence of the method according to the invention in a schematic diagram, where a vehicle 1 is approaching an intersection 2, which has a traffic light signal system 3. The traffic light signal system 3 is controlled by an intersection control computer 4 having an integrated evaluation computer. A station 5 is located just before the intersection.

In addition, the FIGURE also shows various reporting points to which specific data telegrams are allocated:

Advance log-on telegram for reporting point 6. The vehicle is near the intersection where the traffic light signal system is located. The vehicle will soon require a green phase.

Main log-on telegram for reporting point 7. The vehicle is directly at the intersection and needs a green phase now.

Station telegram for reporting point 8. This telegram is used when a station is located just before the traffic light signal system. The telegram informs the traffic light signal system that the vehicle is ready to depart as soon as the doors of the vehicle are closed.

Log-off telegram for reporting point 9. The vehicle has now passed the intersection and the green time can now be terminated.

The vehicle 1 sends a data telegram at each reporting point to the evaluation computer of the traffic light signal system 3. This data telegram contains, in addition to the usual information (destination, line, route, etc.), the following information according to the R09 telegrams in compliance with the Standards of the Association of German Transportation Companies:

| | |
|---|---|
| Destination IP/Destination Port | Destination Address |
| LZmax | Maximum assumed transit time |
| $t_s$ | Transmission time/time stamp |
| MP | Actual reporting point |

With the transmission position 10 moved forward, the only FIGURE shows a transmission position of the main reporting telegram when using the method according to the present invention, according to which the transmission positions are moved forward to reporting point 7. The vehicle having the current speed $v_a$ sends the data telegram sooner than indicated in the schedule data by the distance $v_a$*LZmax. When the data telegram arrives at the evaluation computer, the latter compares the transmission stamp $t_s$ with the current time $t_a$. If the difference $t_a$-$t_s$ is <LZmax, then the data telegram is delayed by the time difference, which results from the difference between LZmax and the calculated difference $t_a$-$t_s$ before being forwarded to the intersection control computer. If $t_a$-$t_s$>LZmax, then the data telegram is discarded.

If the vehicle 1 approaches the reporting point 7 at 60 km/h (=16.67 msec) and the maximum data telegram transit time is 1.5 s, then the transmission position at the reporting point 7 is advanced by the vehicle by 25 m (=1.5 s*16.67 m/sec), i.e., is sent sooner. However, if the data telegram is already received by the evaluation computer after 1 s, then the evaluation computer must wait an additional 0.5 s until it forwards the data telegram to the intersection control computer 4 for further processing.

The evaluation computer at the intersection for use of the method according to the invention is a module consisting of the following components:

communication module, e.g., GPRS/UMTS module
processor module
relay module or serial interface
power supply The evaluation computer is provided for assembly in an electronic cabinet, e.g., a 19" cabinet. The communication module (e.g., GPRS/UMTS module) is connected to the evaluation computer. For example an OEM GPRS module or an OEM UMTS module may be used here. The antenna is installed with an offset, i.e., inside the switchbox in the case of a plastic switchbox or otherwise on the outside.

The processor module is equipped with generous performance, memory and interfaces. This computer hardware then forms the platform for the software application which takes over the evaluation of the UDP packets (IP traffic light signal system telegrams) and the logic control of the interface to the intersection control computer under one operating system.

As a rule a galvanic insulated relay interface is required as an interface with the intersection control computer. The relay module of the evaluation computer having 16 bistable relays fulfills these requirements. The relay module has an interface with the processor module and is controlled by it.

The evaluation computer may be designed with 16 or 32 relays (1 or 2 relay modules). All the contacts (root/normally closed contact/operating contact) lead to the plug.

The connection of the evaluation computer (TSPcu) via IP additionally permits more convenient options with regard to maintenance and configuration:

addressing and communication with the TSPcu take place via IP and standard protocols, the address is stored in the TSPcu, convenient configuration and remote maintenance via GPRS/UMTS, readout of the history memory via remote access.

With regard to additional advantageous embodiments and refinements of the inventive teaching, reference is made to the general part of the description and to the accompanying patent claims to prevent repetition.

Finally it should be pointed out explicitly that the exemplary embodiment of the sequence of a method according to the invention and of the inventive evaluation computer as described above serve only to illustrate the claimed teaching but do not limit it to the exemplary embodiment.

The invention claimed is:

1. A method for enabling a vehicle to influence a traffic light signal system provided with an evaluation computer, said method comprising:

sending, via the vehicle, a data telegram to an evaluation computer to request a green phase at a sending position, at least one of the data telegram or the sending position depending on predefined reporting points, wherein the predefined reporting points are location points, wherein the data telegram is transmitted to the evaluation computer over a packet-oriented radio network and wherein in an approach of the vehicle to a reporting point the sending position is advanced as a function of a current speed of the vehicle and a maximum assumed data telegram transit time, wherein the evaluation computer calculates the transit time of the data telegram based on a difference between a reception time and a sending time on reception of the data telegram, and when the calculated transit time is smaller than the maximum assumed data telegram transit time, further processing or forwarding of the data telegram is delayed by a time difference according to the difference between the maximum assumed data telegram transit time and the calculated transit time.

2. The method according to claim 1, wherein a reporting point is defined by the target address of the evaluation computer and a reporting point number.

3. The method according to claim 1, wherein a maximum assumed data telegram transit time is defined globally.

4. The method according to claim 1, wherein the reporting point, a sending time and a maximum assumed data telegram transit time are transmitted with the data telegram.

5. The method according to claim 1, wherein the data telegram is sent multiple times.

6. The method according to claim 1, wherein an acknowledgement mechanism is used for transmitting the data telegram.

7. The method according to claim 1, wherein the data telegram is discarded when the transit time of the data telegram is greater than the maximum assumed data telegram transit time.

8. The method according to claim 1, wherein data telegrams to be triggered without delay are provided with a certain identifier.

9. The method according to claim 1, wherein the sending position is moved forward so that a higher speed of the vehicle and a data telegram subject to the maximum assumed data telegram transit time are taken into account.

10. The method according to claim 1, wherein local time is synchronized in the vehicle and in the evaluation computer, in particular via NTP (network time protocol), SNTP (simple network time protocol), GPS (global positioning system), UMTS (universal mobile telecommunications system) or a server available in the network.

11. The method according to claim 1, wherein the data telegram is forwarded via a central application-router to the evaluation computer.

12. The method according to claim 1, wherein the packet-oriented radio network is an IP based radio network.

13. An evaluation computer for enabling a vehicle to influence a traffic light signal system, said evaluation computer comprising:

a send or receive unit, for receiving a data telegram, wherein the evaluation computer is configured to receive the data telegram from the vehicle that requests a green phase at a sending position, at least one of the data telegram or the sending position depending on predefined reporting points, wherein the predefined reporting points are location points, wherein the data telegram is transmitted over a packet-oriented radio network to the evaluation computer, wherein in an approach of the vehicle to a reporting point the sending position is advanced as a function of a current speed of the vehicle and a maximum assumed data telegram transit time, and wherein the evaluation computer calculates the transit time of the data telegram based on a difference between a reception time and a sending time on reception of the data telegram, and when the calculated transit time is smaller than the maximum assumed data telegram transit time, further processing or forwarding of the data telegram is delayed by a time difference according to the difference between the maximum assumed data telegram transit time and the calculated transit time.

14. The evaluation computer according to claim 13, wherein the evaluation computer can be operated by means of a relay interface in parallel with an analog evaluation unit.

15. The evaluation computer according to claim 13, wherein the send or receive unit is configured for GPRS (general packet radio service), EDGE (enhanced data rates for GSM evolution), UMTS (universal mobile telecommunications system), TETRA (terrestrial trunked radio), WLAN (wireless local area network) or WIMAX (worldwide interoperability for microwave access).

16. The evaluation computer according to claim 13, wherein the packet-oriented radio network is an IP (Internet protocol) based radio network.

17. An on-board computer for enabling a vehicle to influence a traffic light signal system, said on-board computer comprising:

a send or receive unit, for sending a data telegram, wherein the on-board computer is configured to send the data telegram to an evaluation computer to request a green phase at a sending position, at least one of the data telegram or the sending position depending on predefined reporting points, wherein the predefined reporting points are location points, wherein the data telegram is transmitted over a packet-oriented radio network to the evaluation computer, wherein the on-board computer is further configured in such a way that in an approach of the vehicle to a reporting point the sending position is advanced as a function of a current speed of the vehicle and a maximum assumed data telegram transit time, and wherein the evaluation computer calculates the transit time of the data telegram based on a difference between a reception time and a sending time on reception of the data telegram, and when the calculated transit time is smaller than the maximum assumed data telegram transit time, further processing or forwarding of the data telegram is delayed by a time difference according to the difference between the maximum assumed data telegram transit time and the calculated transit time.

18. The on-board computer according to claim 17, wherein the on-board computer has a module for automatic position determination.

19. The on-board computer according to claim 17, wherein the send or receive unit is configured for GPRS (general packet radio service), EDGE (enhanced data rates for GSM evolution), UMTS (universal mobile telecommunications system), TETRA (terrestrial trunked radio), WLAN (wireless local area network) or WIMAX (worldwide interoperability for microwave access).

20. The on-board computer according to claim 17, wherein the packet-oriented radio network is an IP (Internet protocol) based radio network.

* * * * *